United States Patent [19]

Muller et al.

[11] Patent Number: 4,861,276

[45] Date of Patent: Aug. 29, 1989

[54] ADAPTOR WITH NOTCHED STRAIN RELIEF PLATE

[75] Inventors: Peter H. Muller, Los Gatos; Peter E. Lowe, Palo Alto; Peter R. Edwards, San Lorenzo, all of Calif.; Samuel W. Harris, Norcross, Ga.

[73] Assignee: Hayes Microcomputer Products, Inc., Norcross, Ga.

[21] Appl. No.: 160,352

[22] Filed: Feb. 25, 1988

[51] Int. Cl.[4] ..... H01R 13/627

[52] U.S. Cl. ..... 439/365; 439/362; 439/372

[58] Field of Search ..... 439/144, 373, 676, 372, 439/680, 445, 447, 449

[56] References Cited

U.S. PATENT DOCUMENTS

| | | | |
|---|---|---|---|
| 2,515,257 | 7/1950 | O'Brien | 439/372 |
| 4,093,331 | 6/1978 | Molchan | 439/144 |
| 4,290,664 | 9/1981 | Davis et al. | 439/676 |
| 4,420,209 | 12/1983 | Reis et al. | 439/680 |
| 4,687,271 | 8/1987 | Szoboszlai | 439/369 X |

*Primary Examiner*—Neil Abrams
*Assistant Examiner*—Khiem Nguyen
*Attorney, Agent, or Firm*—Jones, Askew & Lunsford

[57] ABSTRACT

There is disclosed an improved adaptor for connecting a first connector to a data communications plug having at least one flange extending radially therefrom, comprising in combination a body, a first connector at the front end of the body, a well formed within the body and opening onto one of the body sides, a second connector within the well, a notched strain relief plate rotatably connected to one of the body sides of the body, and means for securing the strain relief plate in a closed position, which improved adaptor prevents, by the locking action of the strain relief plate and the flange, the withdrawal of the data communications plug when the plug is inserted into the well to a seated position.

5 Claims, 3 Drawing Sheets

ADAPTOR WITH NOTCHED STRAIN RELIEF PLATE

TECHNICAL FIELD

This invention relates generally to plug and receptacle adaptors for adapting a first electrical connection having a first physical pin configuration to a second electrical connection having a second physical pin configuration. The invention more particularly concerns an improved adaptor generally useful in data communications and computer interconnections having a notched strain relief plate which, when in the closed position, prevents a cable terminated by a plug having a first physical pin arrangement which is inserted into the adaptor from falling or being pulled out of the adaptor.

BACKGROUND OF THE INVENTION

Plug and receptacle adaptors are common in the practice of interconnecting data processing and in data communication devices. One of the most common port configurations used in computing today is the serial data communication ports. It is common to physical implement such ports using the standard DB-25 connector defined in EIA Revised Standard RS-232, which standard is hereby incorporated by reference and is well known to those skilled in the art. As is well known to those skilled in the art, RS-232 defines 25 connections between data terminal equipment (DTE) and data communications equipment (DCE). As is also known to those skilled in the art, the standardization of RS-232 is honored more in the breach than in conformance. This is because the interface defined in the standard document includes a large number of signal and control lines which are superfluous to many applications. As a result of this, a number of manufacturers of data communications and terminal equipment began omitting a number of such signals. Therefore, even when the apparatus in question is interconnected physically by a DB-25 plug or receptacle, a number of the pin positions have no electrical connection thereto or a signal which is held to a particular electrical state.

The well known result of this phenomenon has been a reduction of the number of signal and control lines defined in RS-232 which are actually implemented in a number of popular and commercially successful devices. This has led to a standardized DB-9 physical connection which connects a sub-set of the 25 connections defined for the DB-25 connectors. Even more recently a popular pin configuration known as the circular 8 has been promulgated on computer serial ports by the Apple Computer Company. The circular 8 is familiar to those skilled in the art and physically resembles the DIN connector used on high fidelity audio equipment in Europe. The reduction in size of physical connections for serial communications ports, from DB-25 to DB-9 to circular 8, has been largely motivated by the need to reduce the physical size of the connectors for serial ports as data terminal equipment and data communications equipment has become smaller.

While plug to plug adaptors without intervening cable between the two ports on the adaptor are known in the art, they have generally been used for functions such as gender switching or DTE to DCE (or vice versa) conversions.

Heretofore manufacturers of one type of equipment which may be interconnected to other equipment having electrically similar but physically different connections to a serial port have either had to stock a large variety of cables to service the possible combinations of physical pin configurations which the users might encounter, or leave the users to fend for themselves in obtaining appropriate interconnect cables. Stocking a large number of cables terminated by different physical pin configurations, all of which are to perform essentially the same interconnect function, is expensive and requires significant investment in inventory, some of which may not turn over rapidly.

Additionally, well-made cables for serial ports of any significant length often cost on the order of $15 or $20 apiece.

As is also known to those skilled in the art, multi-conductor cables commonly used with serial data ports tend to have a significant weight per unit length. Placing a plug to plug or plug to receptacle adaptor, such as a gender switching device, between the physical connector to a serial port and a connector cable, provides a physically stiff and elongated structure extending out of the back of the equipment to which it is attached. The weight of the cable tends to put a significant moment on the serial port trying to rotate it around an axis in the plane of the back plate of the device to which this structure is connected. This often leads to cables falling out, unless they are secured by screws or the like.

Modems are data communications devices which, in recent years, have tended to use a small subset of the RS-232 defined signals. However, much of the equipment to which modems are connected still use DB-25 connectors. Also, it is common to connect modems to ports physically manifested by DB-9 connectors and to other physical arrangements. Therefore, there is a need in the art to provide an adaptor which is lightweight, inexpensive, designed to adapt to a large number of physical configurations, and which does not suffer the drawbacks of known cable adaptors. In particular, it is desirable that the adaptor be easily used, and it is highly desirable to have such an adaptor which forms a physically secure connection with devices to which it is attached without undue use of retaining screws and the like.

SUMMARY OF THE INVENTION

The present invention fulfills the need of the prior art by providing an inexpensive adaptor with a first connector at the front end of the body, which may be embodied by a plurality of difference plug/receptacle configurations. A well is located in the body opening on one of the sides (preferably the rear end) and a second connector, normally a receptacle, is disposed within the well. In the broadest conception of the invention, the rear end of the adaptor can be thought of as one of three sides of the body. A notched strain relief plate is rotatably connected to one of the body sides, and when rotated into a closed position, secures a standardized connector within the well.

In its preferred form, the standard connector disposed within the well is among the smaller of the commonly used set of connectors for the application to which the present invention is applied. The preferred embodiment disclosed herein is designed to be used with a serial data communications connection and the standard connector within the well of the preferred embodiment is a circular-8 receptacle.

Additionally, in the preferred embodiment, the standard connector inserted within the well has a case with flanges extending about its periphery transverse to the longitudinal axis of the connector. A notch in the strain relief plate is shaped, sized, and designed to engage a space between a pair of these flanges in order to secure the standard connector in a locked position.

In several embodiments of the present invention, the adaptor plug includes conventional screws extending longitudinally through the adaptor to screw into standardly spaced and sized threaded holes on a mating connector to which the adaptor is to be attached. In the preferred embodiment of the present invention, the shaft of one of these screws is used as an axis of rotation for the notched strain relief plate to selectively rotate same into and out of a closed position. Additionally, a second notch on the strain relief plate closes over the shaft of the screw at the distal end from the one forming the axis of rotation when the plate is moved to the closed position. In this configuration, tightening of the second screw to the threaded hole on the mating terminal plug locks down the strain relief plate in its closed position. Thus the preferred embodiment of the present invention makes use of conventionally provided longitudinally extending screws to serve as both the axis of rotation and a locking mechanism for the strain relief plate.

In most preferred forms of the present invention the first notch on the strain relief plate which secures the standard connector in place is in the shape of a right trapezoid topped by a rectangle. The non-parallel side of the trapezoid is the leading edge of engagement when the notch is closed over the standard connector. In an alternate preferred form of the present invention the leading edge of engagement on the notch is arcuate, and thus will clear the side of the standard connector nearest same when the plate is rotated to its closed position while the standard connector is inserted within the well.

In preferred forms of the present invention a key is provided within the well with a matching keyway on the standard connector to assure proper orientation of the standard connector when it is inserted into the well.

Therefore, it is an object of the present invention to provide an inexpensive adaptor which provides, by the use of a strain relief plate, relief from the strain of heavy cable connections to one end of an adaptor and thus reduces the tendency of the cable weight to pull the adaptor from its connection with the mating plug.

It is a further object of the present invention to provide an improved electrical connection adaptor having a strain relief plate which allows quick release of the cable from the adaptor.

It is a further object of the present invention to provide an improved adaptor having a strain relief plate that requires no permanent clamping or soldering. It is a further object of the present invention to provide an adaptor that is secured by the same sequence of steps that one normally uses in connecting a conventional plug terminated cable to a computer or data terminal port.

It is still a further object of the present invention to provide a system of adaptors which may be produced inexpensively enough so that a computer peripheral device, such as a modem, can be provided with a permanently attached cable with a standard connector terminating same, and a plurality of selectively usable adaptors which will adapt the standard connector terminating the modem cable to a plurality of standard pin configurations for plugs and receptacles.

That the present invention accomplishes these objects and overcomes the previously described drawbacks of the prior art will be appreciated from the description of the preferred embodiment below.

DETAILED DESCRIPTION OF THE INVENTION

Figure 4:
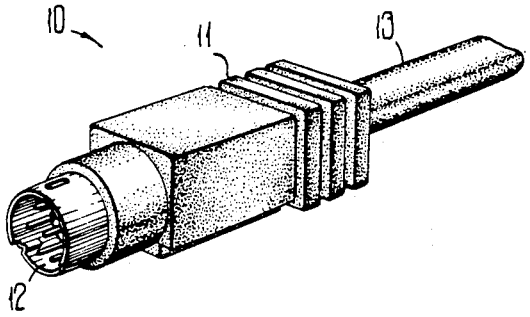
FIG. 4 is a pictorial view of the standard connector used with the preferred embodiment of the present invention.

Turning next to the drawing figures in which like numerals represent like parts, two alternate preferred embodiments of the present invention will now be described.

Figure 1:
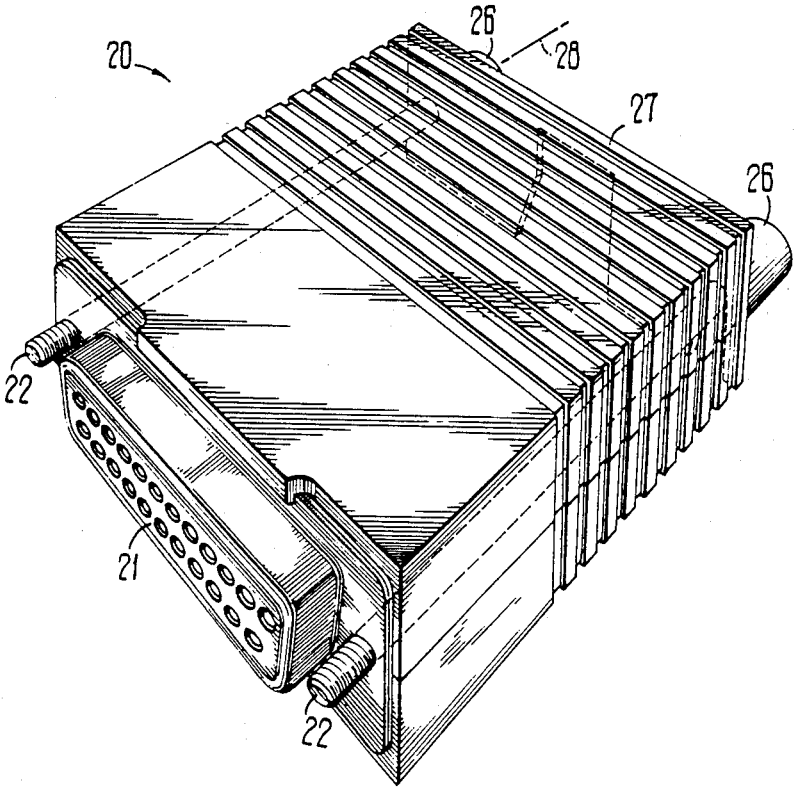
FIG. 1 is a pictorial view of the preferred embodiment of the improved adaptor of the present invention.

FIG. 1 shows an improved adaptor 20 embodying the present invention. The improved adaptor consists of a first connector 21 which includes a plurality of connector pin receptacles. First connector 21 comprises a standard female DB-25 connector in the preferred embodiment. A pair of thumb screws **22*a* and 22*b* extend longitudinally through the body of connector 20 near the sides thereof. Those skilled in the art will recognize the lateral spacing between the longitudinal axes of screws 22 as a standard spacing for screw connectors for DB-25 connectors and receptacles. Conventionally, a mating male DB-25 connector is configured with similarly spaced threaded holds secured thereto so that the screws may be used to tighten the connection between the female receptacle 21** and the male connector (not shown) which is normally used as the serial port for a computer or terminal device.

Screws **22*a* and 22*b* are terminated at the rear by knobs 26*a* and 26*b*, respectively, which are provided to assist the user in operation of the screws when adaptor 20 is connected to a DB-25 plug. Notched strain relief plate 27 is shown in phantom at the rear end of the connector in FIG. 1 and the shafts of screws 22** are also shown in phantom extending the length of the device.

Figure 2A:
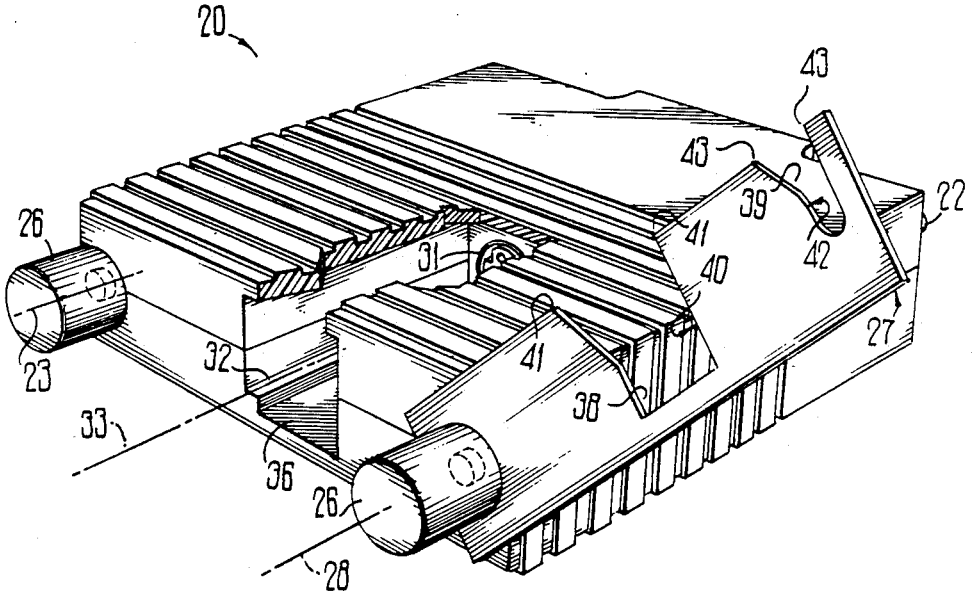
FIG. 2A is a pictorial view of the embodiment of FIG. 1, with the top partially cut away, and showing the strain relief plate in its open position.

As may be appreciated from viewing FIG. 1 and FIG. 2A, screw **22*a* forms the axis of rotation for notched strain relief plate 27. Thus, the rotational axis 28 of the notched strain relief plate is co-linear with the longitudinal axis of screw 22*a***.

Operation of the preferred embodiment may be understood by reference to FIGS. 2A and 4. FIG. 2A is a pictorial view showing the rear of the preferred embodiment with a portion of the top cut away. Strain relief plate 27 is shown in its open position.

As noted hereinabove, a well 36 defines an opening in the rear of the adaptor. A longitudinal axis 33 extends down the center of the well to the center of the standard input connector 31 which, in the preferred embodiment, is a circular 8 type receptacle. In the preferred embodiment, well 36 is square in cross sections taken perpendicular to longitudinal axis 33, except for the presence of key 32 which is used to properly position the standard plug within the well.

FIG. 4 shows the preferred embodiment of the standard plug 10. Plug 10 is connected to some form of computing device or another connector (not shown) by cable 13. As noted above, the environment of the preferred embodiment is that of a small wall mounted modem (not shown) which has a cable permanently attached to the modem to provide a serial port connection thereto. It will be understood by those skilled in the art that application of the present invention is not limited to such an environment.

Plug 10 has a molded plastic body which includes a plurality of flanges, such as flange 11 shown on the drawing. Channels are defined between the flanges. The proximate end of standard connector 13, as shown in FIG. 4, is embodied by a male circular 8 plug shown at 12.

Naturally, the standard connector adopted in any embodiment of the present invention can, within the physical limits of a size constraint, be any plug or receptacle configuration. Therefore, references to this particular standard connector within the meaning of this specification refer to it as a standard within a set of different connector configurations to which the reference standard is adapted. It does not necessarily imply that the first connector embodied by the circular 8 device shown in FIG. 4 must be embodied by an industry established standard. Indeed, same could be a small proprietary arrangement of connectors and still be a standard first connector within the meaning of this specification.

A keyway 14 on the first standard connector shown in FIG. 4 journals with key 32 shown on FIG. 2A when plug 10 is inserted into well 36. The circular 8 male connector includes a standard key 15 shown in FIG. 4 and, when fully seated in the bottom of the well, plug 12 engages circular 8 receptacle 31 to establish electrical contact therewith.

The structural features of strain relief plate 27 are shown in FIG. 2A. Plate 27 has two notches therein. A first notch 38 is cut into plate 27 between two edge points 41*a* and 41*b*, and define a first notch periphery 40 extending along the edges of notch 38 between points 41*a* and 41*b*. The first notch is of a geometry approximating a right trapezoid contiguous with a rectangle having a length equal to the shortest distance between the non-parallel sides of the trapezoid.

A second notch is shown at 39 and is cut into plate 27 to define a second notch periphery 42 between edge points 43*a* and 43*b*. The portion of second notch periphery 42 closest to edge point 43*a* intersects the bottom edge of plate 27 at an acute angle, as does the corresponding edge of first notch 38 at point 41*a*.

When the strain relief plate is rotated into its closed position (see FIG. 5) the plane of first notch 38 intersects longitudinal axis 33 of well 36. Similarly, when the strain relief plate is rotated to its closed position the plane of second notch 39 intersects longitudinal axis 23 of screw 22*b* so that advancement of the screw toward the front of the adaptor will secure the strain relief plate in its closed position.

Figure 2B:
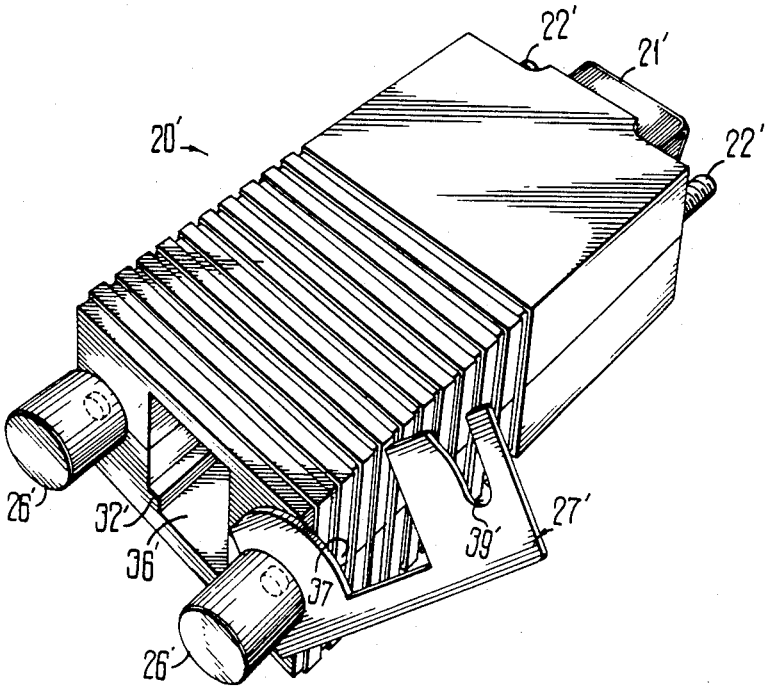
FIG. 2B is a pictorial view of an alternate preferred embodiment of the adaptor of the present invention.

In FIG. 2B an alternate embodiment of the adaptor of the present invention is shown as 20'. The second embodiment includes a well 36' of identical geometry to well 36 of the first embodiment. The standard connecting screws are terminated by knobs 26A' and 26B' shown in the Figure. The second connector to which adaptor 20' adapts is a standard DB-9 female receptacle (not shown) located at 21'.

As may be seen by inspection of FIGS. 2A and 2B, adaptors 20 and 20' are substantially identical except that adaptor 20 is wider and adapts the lines of the circular 8 receptacle 31 to certain lines of DB-25 connector 21 (FIG. 1) and adaptor 20' is relatively narrower and adapts the circular 8 to a DB-9 receptacle.

The embodiment of FIG. 2B has a second notch 39' of substantially identical geometry to notch 39 shown in FIG. 2A. First notch 38' on the alternate embodiment is defined between edge points 41*b'* and 41*a'*. This notch geometry has an arcuate edge 34 which, when plate 27' is rotated to its closed position, will clear the channels defined by flanges 11 (FIG. 4) sufficiently to allow complete rotation of the plate between its open and closed positions.

Figure 3A:
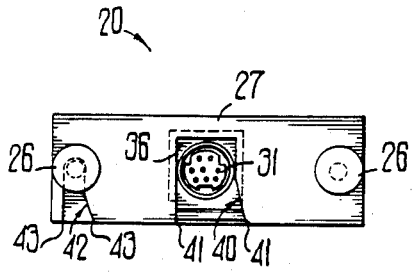
FIG. 3A is a rear elevational view of the preferred embodiment showing the strain relief plate in its closed position.
Figure 3B:
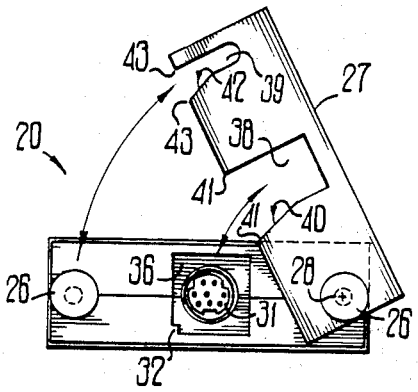
FIG. 3B is a rear elevational view of the preferred embodiment showing the strain relief plate in its open position.
Figure 5:
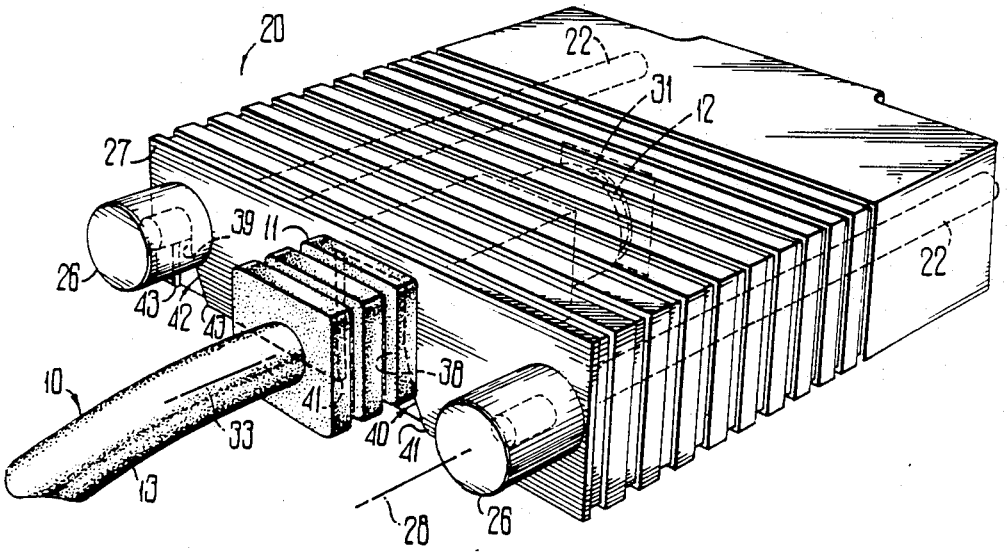
FIG. 5 is a pictorial view of the preferred embodiment of the present invention showing longitudinally extending screws through the body and the standard connector seated within the well in phantom.

FIGS. 3A and 3B are rear elevational views of the first preferred embodiment showing the strain relief plate in its closed and open positions, respectively. FIGS. 3A, 3B, and 5 will now be used to explain the operation of the preferred embodiment. Assume for the moment that the user wants to connect the device attached to cable 13 (FIG. 4) to a serial port having a standard DB-25 male plug thereon. The user first selects the adaptor of FIG. 20 as appropriate for connection to this port because it adapts the circular 8 plug to a DB-25 female receptacle. Next, the user will move strain relief 27 to its open position shown in FIG. 3B. Thereafter, standard connector 10 (FIG. 4) is inserted into well 36 until it is firmly seated and connector 12 engages receptacle 31 in the bottom of the well, as shown in phantom in FIG. 5.

Next, the user rotates plate 27 to its closed position which is shown in FIG. 3A. Notch periphery 40 of notch 38 closes over the body of standard connector 10 and engages the channel immediately forward of flange 11. It will be appreciated that the leading edge of notch periphery 40 proximate edge point 41*a* is shaped so as to clear the side of connector 10 proximate axis of rotation 28. Thus, when plate 27 is rotated to its closed position shown in FIGS. 3A and 3B, the plane of second notch 39 intersects the axis of screw of 22*b*, and the plane of first notch 38 intersects longitudinal axis 33 of well 36.

It will be appreciated by those skilled in the art that the clamping of edge periphery 40 within the channel between flanges 11 is sufficient to create a very stable configuration. When the user subsequently attaches the adaptor to the above described serial port (not shown) by means of insertion and rotation of screws 22, screw 22*b* will, through rotation of thumb knob 26*b*, will push plate 27 toward the body of adaptor 20. Under these conditions, the plate 27 will be securely clamped to the body and there is no way for cable 13 and connector 10 to accidentally fall out of its position of engagement with receptacle 31.

Other embodiments of the present invention will suggest themselves to those skilled in the art. For example, the notched strain relief plate could be mounted as part of an L-shaped bracket and rotated about an axis of rotation on one of the lateral sides of the body. In such an embodiment, a third notch would be located at the current location of the pivot point about axis of rotation 28. This embodiment is less desirable than those disclosed herein due to the fact that a separate axis of rotation must be provided.

In view of the foregoing description of alternate preferred embodiments, the following features of the present invention will be appreciated by those skilled in the art.

First, the adaptor device of the present invention may be manufactured relatively inexpensively, as compared to conventional cables terminated by differing pin configurations which perform the same function. For example, it is economically possible to provide a purchaser of a particular device, such as a modem, with a plurality of embodiments of the improved adaptor of the present invention so that the one he or she needs to connect the device to a computer or terminal may simply be selected and installed at the time the modem is installed. Providing the user with a similar selection of adapting cables is prohibitively expensive in most applications.

Additionally, the fact that the present invention is so much cheaper than a corresponding adaptor cable allows a manufacturer employing a device with a permanently connected cable and standard connector such as that shown in FIG. 4 to stock adequate supplies of various alternative embodiments of the present invention without having an undo amount of money tied up in an inventory of adaptor cables.

In view of the foregoing description of alternate embodiments of the improved adaptor of the present invention, it will be appreciated by those skilled in the art that the present invention accomplishes the objects set forth above and overcomes the previously described drawbacks of the prior art. In view of the foregoing description, it will be appreciated by those skilled in the art that many alternative embodiments of the present invention can be created and therefore the scope of the present invention is to be limited only by the claims below.

We claim:

1. An adaptor for positioning intermediate a data communications plug and mating connector to which the adapter is to be attached, comprising in combination:

a body;

a first connector, disposed at a front end of said body and configured for connection with said mating connector;

a well formed within said body having an opening disposed at a rear end of said body, a plurality of side walls, and a well longitudinal axis;

a second connector disposed within said well;

a first headed retaining screw extending through said body and engaging said mating connector;

a strain relief plate rotatably connected to said rear end of said body for selective rotation between an open position and a closed position about a rotational axis substantially common to the longitudinal axis of said first headed retaining screw and substantially parallel to, and disposed laterally from, said longitudinal axis, said strain relief plate including a notch formed therein defining a notched periphery; and a second headed retaining screw extending through said body and engaging said mating connector, said second screw configured for securing said strain relief plate in said closed position such that said plate is parallel and adjacent to said rear end of said body and said notch periphery lies in a plane perpendicular to said well longitudinal axis.

2. An adaptor as recited in claim 1, wherein said first and second retaining screws extend through said body between said front and rear ends of said body; and wherein said first screw forms an axle defining said rotational axis.

3. An adaptor as recited in claim 1, further comprising a key disposed along one of said side walls of said well.

4. An adaptor for facilitating data transmission between a data communications plug and a mating connector to which the adapter is to be attached, said plug having at least one flange extending radially therefrom, comprising in combination:

a body having a front end, and at least three body sides;

a first connector, disposed at said front end of said body;

a well formed within said body so that said data communications plug may be selectively inserted into said well to a seate position and having an opening in one of said three body sides of said body, a plurality of side walls, and a characteristic well longitudinal axis;

a second connector disposed within said well, said second connector having a configuration of pin connectors which is compatible with said data communications plug;

a strain relief plate rotatably connected to one of said body sides of said body for selective rotation between an open position and a closed position about a rotational axis disposed laterally from said longitudinal axis;

said strain relief plate including a notch formed therein cutting into at least one edge of said strain relief plate at two edge points and forming a notch periphery surface such that when said data communications plug is inserted into said well to said seated position and said strain relief plate is in said closed position, said flange is forward of said strain relief plate and said notch periphery surface engages said flange, thereby preventing withdrawal of said data communications plug; and a pair of retaining screws for securing said strain relief plate in said closed position, said retaining screws each extending through said body and each engaging said mating connector.

5. An adaptor for positioning intermediate a data communications plug and a mating connector to which the adapter is to be attached, comprising in combination:

a body;

a first connector, disposed at a front end of said body and configured for connection with said mating connector;

a well formed within said body having an opening disposed at a rear end of said body, a plurality of side walls, and a well longitudinal axis;

a second connector disposed within said well;

a first headed retaining screw extending through said body and engaging said mating connector;

a strain relief plate rotatably connected to said rear end of said body for selective rotation between an open position and a closed position about a rotational axis substantially common to the longitudinal axis of said first headed retaining screw and substantially parallel to, and disposed laterally from, said longitudinal axis, said strain relief plate including a notch formed therein defined a notched periphery; and a second headed retaining screw extending through said body and engaging said mating connector, said second screw configured for securing said strain relief plate in said closed position such that said plate is parallel and adjacent to said rear end of said body and said notch periphery lies in a plane perpendicular to said well longitudinal axis, said first and second headed retaining screws each including heads configured such that a portion of each of said heads may be biased against said strain relief plate such that when said first and second headed screws are rotated into a tightened position, said strain relief plate is releasably locked in said closed position.

* * * * *